US007118634B2

(12) United States Patent
Goldsteinas et al.

(10) Patent No.: US 7,118,634 B2
(45) Date of Patent: Oct. 10, 2006

(54) LOW-PRESSURE CEMENTATION METHOD

(75) Inventors: Aymeric Goldsteinas, Voreppe (FR); Laurent Pelissier, Saint Jean de Moirans (FR)

(73) Assignee: BNP Parlbas, (FR)

( * ) Notice: Subject to any disclaimer, the term of this patent is extended or adjusted under 35 U.S.C. 154(b) by 235 days.

(21) Appl. No.: 10/258,410

(22) PCT Filed: Feb. 22, 2002

(86) PCT No.: PCT/FR02/00674

§ 371 (c)(1),
(2), (4) Date: May 6, 2003

(87) PCT Pub. No.: WO02/068707

PCT Pub. Date: Sep. 6, 2002

(65) Prior Publication Data

US 2003/0168125 A1 Sep. 11, 2003

(30) Foreign Application Priority Data

Feb. 23, 2001 (FR) ..... 01 02513

(51) Int. Cl.
*C23C 8/20* (2006.01)
*C23C 8/22* (2006.01)

(52) U.S. Cl. ..... 148/223; 148/235
(58) Field of Classification Search ..... 148/206, 148/223, 235

See application file for complete search history.

(56) References Cited

U.S. PATENT DOCUMENTS

| | | | | |
|---|---|---|---|---|
| 1,799,614 | A * | 4/1931 | Coberly | 148/197 |
| 4,035,203 | A | 7/1977 | L'Hermite et al. | 148/16.5 |
| 4,322,255 | A | 3/1982 | Kostelitz | 148/16.5 |
| 4,472,209 | A | 9/1984 | Langerich et al. | 148/13 |
| 6,258,179 | B1 * | 7/2001 | Takayama et al. | 148/233 |

FOREIGN PATENT DOCUMENTS

| | | | |
|---|---|---|---|
| EP | 0 080 124 | | 6/1983 |
| EP | 0 532 386 | A1 | 3/1993 |
| EP | 0 818 555 | A1 | 1/1998 |
| EP | 0 408 511 | B1 | 3/1998 |
| EP | 0 882 811 | A1 | 12/1998 |
| FR | 2 678 287 | | 12/1992 |
| FR | 2678287 | A1 * | 12/1992 |
| GB | 1 510 481 | | 5/1978 |
| GB | 1 559 690 | | 1/1980 |
| JP | 2000-336469 | * | 12/2000 |

* cited by examiner

*Primary Examiner*—Roy King
*Assistant Examiner*—Michael P. Alexander
(74) *Attorney, Agent, or Firm*—Duane Morris

(57) ABSTRACT

The invention relates to a low-pressure carburising method comprising alternating low-pressure enrichment steps and diffusion steps in the presence of a neutral gas. During the enrichment steps, an enriching gas and neutral gas mixture is used, the proportion of the neutral gas being between 5 and 50% by volume of the enriching gas. The enriching gas can be, for example, acetylene ($C_2H_2$).

7 Claims, 3 Drawing Sheets

LOW-PRESSURE CEMENTATION METHOD

PRIORITY FILING

This application claims priority of the earlier filing date, under 35 U.S.C. 119, of the commonly owned PCT-based patent application, filing number PCT/FR02/00674, filed on Feb. 22, 2002, which claims priority of French Application No. 01/02513 filed on Feb. 23, 2001.

The present invention relates to the processing of metal parts and more specifically to cementation, that is, the introduction of carbon down to a given depth of the parts to improve their mechanical features.

A specific low-pressure cementation method has already been described in French patent no 2678287 of the applicant (inventor: Jean Naudot). This patent provides alternating enrichment steps and diffusion steps. It specifies that the cementation gas may be any hydrocarbon capable of dissociating at work temperatures to cement the parts to be processed. However, this method more specifically provides using propane as the cementation gas and nitrogen as the neutral gas between cementation phases.

Further, an article by Jelle H. Kaspersma and Robert H. Shay published in Metallurgical Transactions, volume 13B, June 1982, studies the cementation speeds linked to the use of various enrichment gases and the soot formation problems. It indicates that acetylene is the gas enabling the fastest cementation, but with the disadvantage of generating the most soot in the processing chamber.

Various attempts have been made to enable use of acetylene while solving the problem of soot and tar generation.

Russian patent no 6678978 filed on Jun. 2, 1977 provides injecting acetylene in the cementation chamber at a temperature from 850 to 1000° C., while varying the pressure from 0.01 to 0.95 atmosphere (from 1 to 95 kPa) with a pressure change rate from 0.001 to 1 atmosphere per hour. It explains that the amount of soot is reduced especially when the pressure increase rate is very small. However, this method is complex. As far as the applicant knows, the method described in this Russian patent has not had any industrial exploitation and it has not been possible to verify the results of the provided solution.

Another solution is provided in U.S. Pat. No. 5,702,540 (Kubota) in which it is suggested to use acetylene at a pressure smaller than 1 kPa. It indicates that remarkable soot traces appear from approximately 0.7 kPa and that a significant amount of soot appears under 1 kPa. Further, the description of this patent application indicates that the cementation features deteriorate between the outside and the inside of a part from as soon as the pressure exceeds 0.3 kPa. Experiments made by the applicant have confirmed the occurrence of soot as soon as the pressure exceeds a value on the order of 0.5 kPa but, however, have indicated that, to obtain a satisfactory cementation inside of cavities, or when the load of the cementation reactor is very high, the pressure should be increased. The solution provided in the above referenced patent thus does not seem to enable satisfactory use of acetylene.

The present invention provides a novel method enabling efficient use of acetylene and more generally of any cementation gas likely to generate soot and tar.

To achieve this object, the present invention provides a low-pressure cementation method consisting of using an alternation of low-pressure enrichment steps and of steps of diffusion in the presence of a neutral gas in which, during enrichment steps, a mixture of an enrichment gas and of a carrier gas is used, the carrier gas being in a proportion of from 5 to 50% in volume of the enrichment gas.

According to an embodiment of the present invention, the enrichment gas is acetylene ($C_2H_2$).

According to an embodiment of the present invention, the carrier gas is nitrogen.

According to an embodiment of the present invention, the carrier gas is hydrogen.

According to an embodiment of the present invention, the carrier gas comprises nitrogen and hydrogen in a proportion of from 5 to 60%.

According to an embodiment of the present invention, the pressure in the cementation chamber is greater than 1 kPa.

According to an embodiment of the present invention, the pressure in the cementation chamber ranges between 1 and 2 kPa.

According to an embodiment of the present invention, the diffusion and enrichment steps are carried out substantially at the same pressure.

According to an embodiment of the present invention, the processing temperature is on the order of from 850 to 1200° C.

According to an embodiment of the present invention, each of the enrichment steps is divided into sub-steps of a duration shorter than one minute separated by diffusion sub-steps of a duration shorter than one half-minute, preferably on the order of some ten seconds.

The foregoing objects, features and advantages of the present invention will be discussed in detail in the following non-limiting description of specific embodiments in connection with the accompanying drawings, in which.

Figure 3:
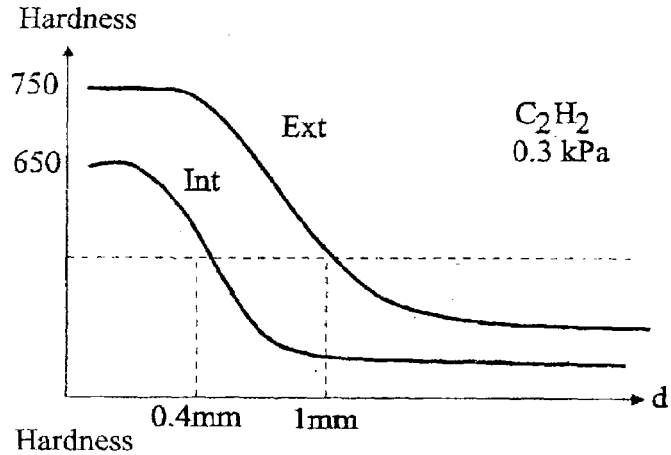
FIGS. 3 to 6 illustrate results of cementation experiments.
Figure 4:
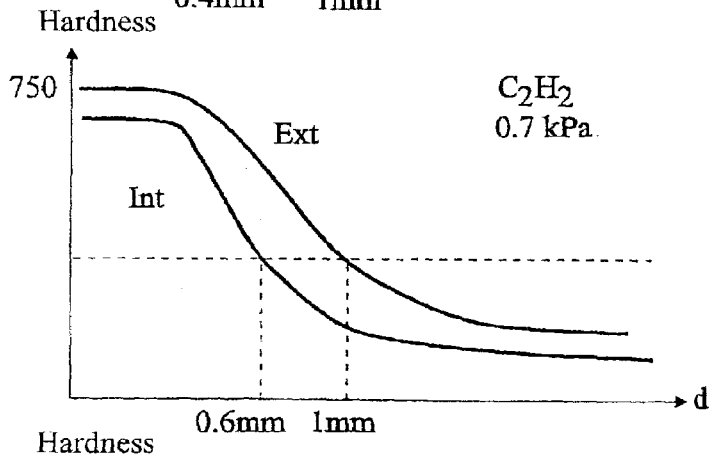
Figure 5:
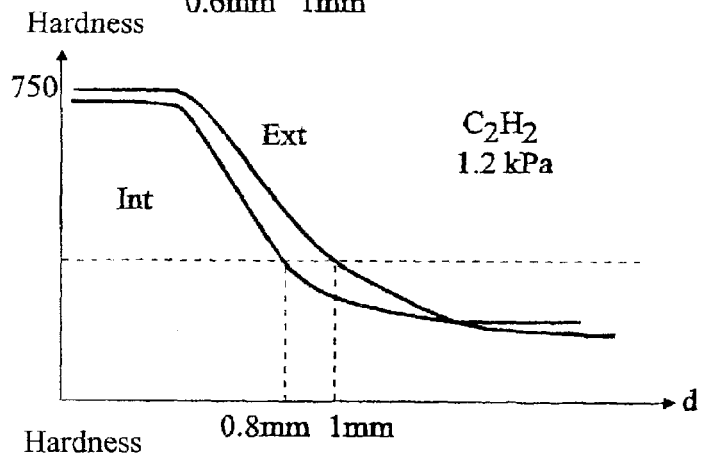
Figure 6:
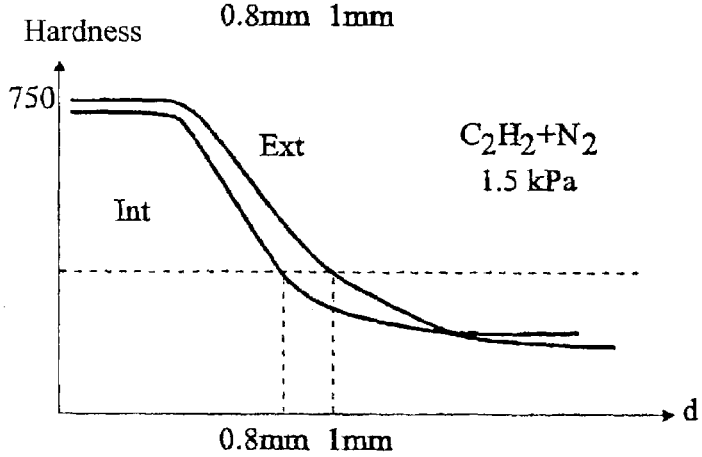
Figure 7:
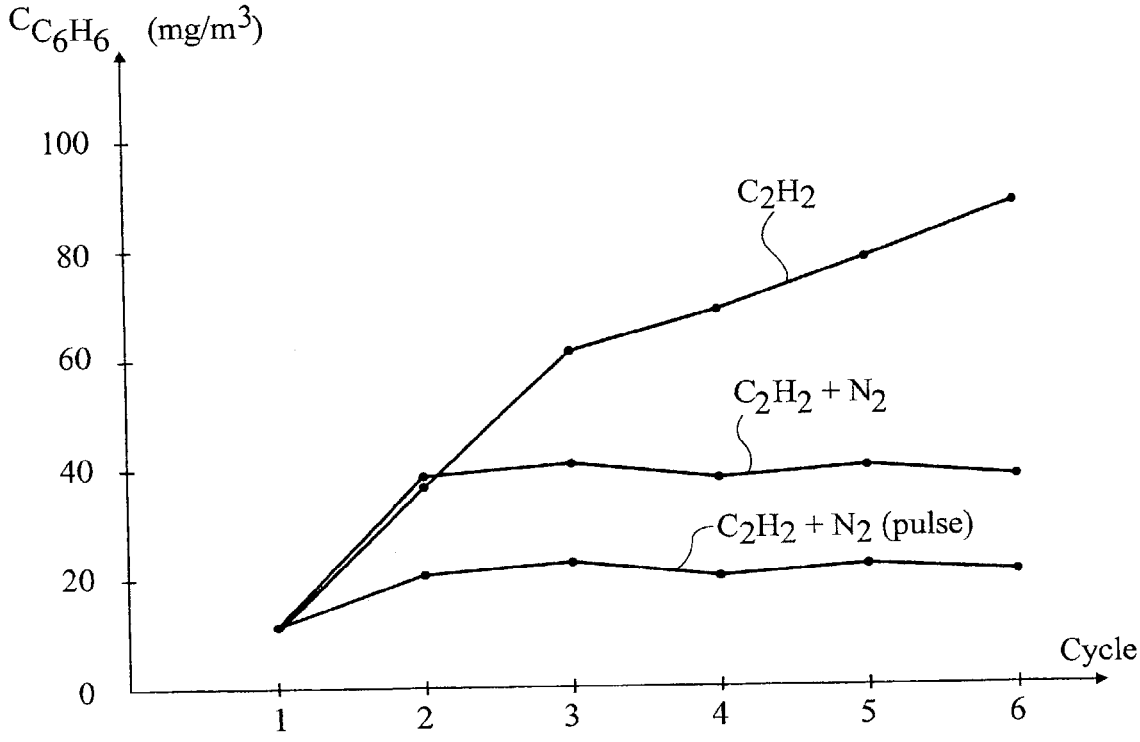

in FIG. 3, the cementation gas is $C_2H_2$ and the pressure is 0.3 kPa, in FIG. 4, the cementation gas is $C_2H_2$ and the pressure is 0.7 kPa, in FIG. 5, the cementation gas is $C_2H_2$ and the pressure is 1.2 kPa, and in FIG. 6, according to the present invention, the gas injected in cementation phases is a mixture of $C_2H_2$ and of nitrogen and the pressure is 1.5 kPa; and FIG. 7 illustrates experimental results characterizing the forming of tar in successive cementation cycles.

Figure 1:
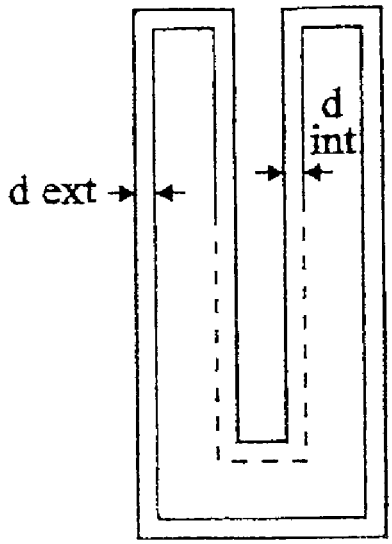
FIG. 1 shows a steel test piece to which a cementation method is applied.

The applicant has performed various cementation experiments on a test piece of the type shown in FIG. 1, formed of a steel cylinder provided with a blind bore, and measurements have been performed as to the cementation depth $d_{ext}$ outside of the test piece and as to the cementation depth $d_{int}$ inside of the bore formed in the test piece.

Figure 2:
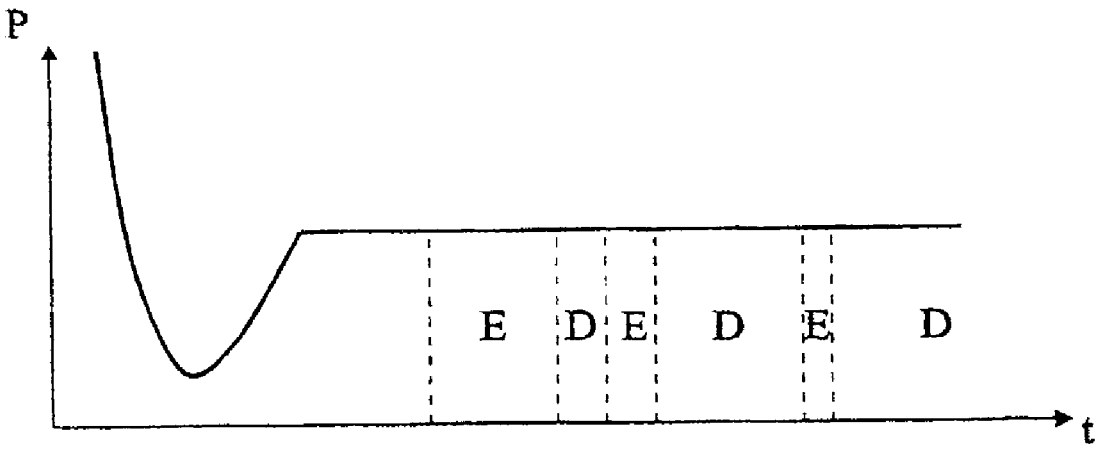
FIG. 2 is a curve of the pressure versus time illustrating successive phases of a cementation-diffusion method.

FIG. 2 shows a cementation-diffusion cycle of the type described in French patent 2678287 and used according to the present invention. The cementation-diffusion operations are performed at constant temperature and at constant pressure after an initial temperature and pressure setting phase. Enrichment phases E during which a cementation gas is injected into a cementation chamber containing loads, among which at least one test piece of the type shown in FIG. 1, and diffusion steps in which a neutral gas is inserted in the chamber, are successively carried out along time. To vary the cementation depth, the durations and the number of the respective enrichment and diffusion steps are modified.

Typically, the temperature ranges between 850 and 1200° C., the duration of each of the enrichment and/or diffusion phases being on the order of a few minutes.

First, the applicant has performed series of experiments on a test piece of the type in FIG. 1 with pure acetylene ($C_2H_2$) as a cementation gas. The curves of FIGS. 3, 4, and 5 correspond to three specific pressures, maintained in the cementation-diffusion phases, that is, respectively, 0.3 kPa for FIG. 3, 0.7 kPa for FIG. 4, and 1.2 kPa for FIG. 5. Each of the curves shows the hardness according to the cementation depth for a point taken outside (Ext) of the test piece and for a point taken inside (Int) of the test piece. The different points of each curve result from the testing of various test pieces having been submitted to different processing durations.

As shown in FIG. 3, for a pressure on the order of 0.3 kPa, a great difference can be noted between the cementation depth inside of the test piece and outside of the test piece, that is, the obtained result is not satisfactory since the cementation is insufficient inside of the test piece. For example, if a cementation depth of 1 mm is aimed at, it appears that, when this depth is obtained outside, the cementation depth is only 0.4 mm inside.

A poor result is also obtained in the case of FIG. 4 where the pressure is 0.7 kPa. When the outside cementation depth is 1 mm, the inside cementation depth is only 0.6 mm.

However, satisfactory results start being obtained in terms of cementation from the time when the pressure exceeds 1 kPa. For example, FIG. 5 shows results obtained for a 1.2-kPa pressure: when the cementation depth outside of the test piece reaches 1 mm, the inside cementation depth reaches 0.8 mm, which corresponds to generally-admitted standards.

Further, if the cementation depth inside of the test piece towards the top of the test piece and towards the bottom of the test piece are distinguished, only from the moment when the pressure exceeds 0.5 kPa does there appear to be a cementation homogeneity inside of the test piece.

The generation of soot and tar has been tested and the creation of soot and tar has appeared to be negligible in the case where the pressure is 0.3 kPa, but to become significant from 0.7 kPa on.

The present invention provides using a cycle of the type shown in FIG. 2, and injecting, no longer a pure cementation gas, but a mixture of a cementation gas and of a carrier gas. Preferably, the proportion of carrier gas will be chosen to be on the order of from 25 to 50% of the amount of enrichment gas.

FIG. 6 indicates that a satisfactory cementation substantially identical to that illustrated in FIG. 5 is then obtained, for example, for a mixture of acetylene ($C_2H_2$) and nitrogen ($N_2$) with a total 1.5-kPa pressure and a proportion of approximately 30% of nitrogen. However, in this case, the problem of soot and tar forming is solved.

FIG. 7 shows the benzene ($C_6H_6$) concentration observed at the end of successive enrichment cycles. Indeed, the forming of tar implies a phase of generation of aromatic compounds such as benzene and phenylethylene. The generation of benzene is thus a good indicator of the forming of soot and tars. In FIG. 7, the curves marked as $C_2H_2$ and $C_2H_2+N_2$ respectively correspond to the cases described in relation with FIGS. 5 and 6. It is acknowledged that, by using pure acetylene according to prior art, the benzene concentration significantly increases at the end of each enrichment cycle, which effectively corresponds to a significant tar formation. However, in the case of a mixture of acetylene ($C_2H_2$) and nitrogen ($N_2$), according to the present invention, the benzene concentration remains substantially constant, which corresponds to a negligible tar formation.

More generally, the present invention provides, in all the cases where a cementation is performed in the presence of an aliphatic hydrocarbon in conditions where soot and tar generation problems are posed, adding a neutral gas. Preferably, the proportion of neutral gas will be chosen to be on the order of from 5 to 50% of the amount of enrichment gas. The soot and tar generation problems are very strongly posed in the case of acetylene in which the present invention is particularly useful, but are also posed in the case of other hydrocarbons, for example, propane ($C_3H_8$).

The neutral gas is not necessarily nitrogen, but may be any other type of gas which is not involved in the cementation reaction, for example, argon or a gas mixture. Nitrogen will preferably be chosen due to its low cost. However, for specific requirements, or if the gas costs become lower, any other neutral gas or carrier gas may be chosen to solve the soot and tar generation problem.

The applicant has also shown that there can be an advantage in adding hydrogen in cementation phases. If a neutral gas comprising a proportion of from 5 to 40% in volume of hydrogen is added, a perfectly satisfactory characteristic curve such as that of FIG. 6 (to be compared with that of FIG. 4 in the case where acetylene alone is used) is obtained.

It can be thought that the dissolving of hydrogen by the carrier gas in enrichment phases reduces the polymerization reactions of acetylene and its derivatives, which brings about the significant acknowledged decrease in the amount of tar formed inside of the furnace and possibly at the pumping group level.

The use of a mixture of hydrogenated nitrogen has the additional advantage of favoring the decomposition kinetics or the thermal cracking of acetylene, which brings about a better penetration into cavities and a regular cementation. Indeed, even for a low pressure, a homogeneous cementation of the walls of deep cavities can then be obtained. An advantage of this solution is that the amount of cementation gas and thus the pollution and the gas effluents are then reduced.

According to another alternative of the present invention, the applicant has shown that the tar formation could further be reduced by modifying the relative duration of the enrichment (E) and diffusion (D) cycles described in relation with FIG. 2. Conventionally, for example, six enrichment and diffusion cycles having durations on the order of those indicated in the following table (in seconds) are provided.

| E1 | D1 | E2 | D2 | E3 | D3 | E4 | D4 | E5 | D5 | E6 | D6 |
|---|---|---|---|---|---|---|---|---|---|---|---|
| 520 | 100 | 190 | 150 | 150 | 300 | 100 | 350 | 80 | 450 | 60 | 600 |

The applicant provides dividing each of the enrichment cycles into short steps followed with short diffusion times. For example, enrichment steps having a maximum duration of 50 s followed by a diffusion step of a duration on the order of 10 s may be provided. The first enrichment cycle E1 will then comprise 10 or 11 enrichment steps, each of which is followed with a diffusion step of some ten seconds, the final diffusion step D1 being maintained substantially at its initial duration indicated in the above table. The second enrichment cycle E2 will comprise 4 enrichment steps, each of which is followed with a diffusion step of some ten seconds, the final diffusion step D2 being maintained substantially at its initial duration indicated in the above table. And so on. The benzene concentration at the end of each enrichment cycle for this pulsed operating mode is indicated in FIG. 7 by curve $C_2H_2+N_2$ (pulse). It can be seen that the benzene concentration is substantially divided by two with respect to the case where uninterrupted cycles are conventionally used.

Other modifications of the cycles, for example, the choice, for a given pressure, of variable flow rates, may bring additional improvements.

The invention claimed is:

1. A low-pressure cementation method comprising using an alternation of low-pressure enrichment steps and of steps of diffusion in the presence of a neutral gas wherein, during the enrichment steps, a mixture of an acetylene ($C_2H_2$) enrichment gas and of a carrier gas is used, the carrier gas being in a proportion of from 5 to 50% in volume of the enrichment gas; wherein the carrier gas is nitrogen.

2. The low-pressure cementation method of claim 1, wherein hydrogen in a proportion of from 5 to 60% is added to the nitrogen.

3. The low-pressure cementation method of claim 1, wherein the pressure in a cementation chamber is greater than 1 kPa.

4. The low-pressure cementation method of claim 1, wherein the pressure in a cementation chamber ranges between 1 and 2 kPa.

5. The low-pressure cementation method of claim 1, wherein the diffusion and enrichment steps are carried out substantially at the same pressure.

6. The low-pressure cementation method of claim 1, wherein the processing temperature is on the order of from 850 to 1200° C.

7. The low-pressure cementation method of claim 1, wherein each of the enrichment steps is divided into sub-steps of a duration shorter than one minute separated by diffusion sub-steps of a duration shorter than one half-minute.

* * * * *